US008794701B2

(12) United States Patent
Nakayama et al.

(10) Patent No.: US 8,794,701 B2
(45) Date of Patent: Aug. 5, 2014

(54) BACKREST FOR CHAIR

(75) Inventors: Ken Nakayama, Kanagawa (JP); Kouichirou Wakizono, Kanagawa (JP); Ryou Igarashi, Kanagawa (JP)

(73) Assignee: Okamura Corporation, Yokohama-shi, Kanagawa (JP)

( * ) Notice: Subject to any disclaimer, the term of this patent is extended or adjusted under 35 U.S.C. 154(b) by 177 days.

(21) Appl. No.: 13/502,968

(22) PCT Filed: Oct. 19, 2010

(86) PCT No.: PCT/JP2010/068340

§ 371 (c)(1),
(2), (4) Date: Apr. 19, 2012

(87) PCT Pub. No.: WO2011/049071

PCT Pub. Date: Apr. 28, 2011

(65) Prior Publication Data

US 2012/0223566 A1 Sep. 6, 2012

(30) Foreign Application Priority Data

Oct. 19, 2009 (JP) ..... 2009-240145

(51) Int. Cl.
*A47C 27/00* (2006.01)

(52) U.S. Cl.
USPC ..... 297/218.1; 297/440.11

(58) Field of Classification Search
USPC ..... 297/452.12, 452.13, 452.18, 452.58, 297/452.59, 218.1, 218.3, 440.11
See application file for complete search history.

(56) References Cited

U.S. PATENT DOCUMENTS

| | | | | |
|---|---|---|---|---|
| 2,534,502 | A * | 12/1950 | Dewey | 297/452.59 |
| 5,443,303 | A * | 8/1995 | Bauer et al. | 297/408 |
| 5,560,677 | A * | 10/1996 | Cykana et al. | 297/218.3 |
| 6,050,646 | A | 4/2000 | Stenzel et al. | |
| 6,152,534 | A * | 11/2000 | Maeda et al. | 297/218.3 |
| 6,241,188 | B1 * | 6/2001 | Simpson et al. | 297/218.3 |
| 6,508,509 | B2 * | 1/2003 | Peterson | 297/440.11 |

(Continued)

FOREIGN PATENT DOCUMENTS

| | | |
|---|---|---|
| EP | 0 922 419 A2 | 6/1999 |
| EP | 2 215 931 A1 | 8/2010 |

(Continued)

OTHER PUBLICATIONS

International Search Report issued in International Application No. PCT/JP2010/068340, dated Nov. 16, 2010.

(Continued)

*Primary Examiner* — Jose V Chen
(74) *Attorney, Agent, or Firm* — McDermott Will & Emery LLP

(57) ABSTRACT

A backrest for a chair, including a bag-like upholstery material, with which a back frame is upholstered by fitting the bag-like upholstery material onto the back frame that has a pair of right and left side frames extending in an up-down direction. A low-friction member is disposed on at least one of an inner surface of both side portions of the upholstery material and an outer surface of the right and left side frames contacting the inner surface of the side portions of the upholstery material, the low-friction member being configured to reduce a sliding resistance in an area of contact between the upholstery material and the side frames.

7 Claims, 7 Drawing Sheets

(56) References Cited

U.S. PATENT DOCUMENTS

| | | | | |
|---|---|---|---|---|
| 6,543,843 | B1 * | 4/2003 | Moilanen | 297/218.3 |
| 6,572,190 | B2 * | 6/2003 | Koepke et al. | 297/284.1 |
| 6,592,181 | B2 * | 7/2003 | Stiller et al. | 297/218.2 |
| 6,832,812 | B2 * | 12/2004 | Riley et al. | 297/218.1 |
| 6,866,337 | B1 * | 3/2005 | Lash | 297/219.1 |
| 6,886,890 | B2 * | 5/2005 | Rowland et al. | 297/440.11 |
| 7,055,911 | B2 * | 6/2006 | Simpson et al. | 297/440.11 |
| 7,093,898 | B2 * | 8/2006 | Ladron De Guevara | 297/284.6 |
| 7,108,330 | B2 * | 9/2006 | Mizelle et al. | 297/452.57 |
| 7,419,212 | B2 * | 9/2008 | Haygood et al. | 297/218.5 |
| 7,517,024 | B2 * | 4/2009 | Cvek | 297/452.13 |
| 7,669,936 | B2 * | 3/2010 | Aubriet et al. | 297/452.56 |
| 7,775,589 | B1 * | 8/2010 | Cvek | 297/218.3 |
| 7,837,272 | B2 * | 11/2010 | Masunaga et al. | 297/218.1 |
| 7,857,383 | B2 * | 12/2010 | Nguyen et al. | 297/218.1 |
| 7,862,120 | B2 * | 1/2011 | Ueda | 297/297 |
| 8,118,363 | B2 * | 2/2012 | Tanaka et al. | 297/218.2 |

FOREIGN PATENT DOCUMENTS

| | | | |
|---|---|---|---|
| JP | 2003-009998 | A | 1/2003 |
| JP | 2003-039289 | A | 2/2003 |
| JP | 2003-135200 | A | 5/2003 |
| JP | 2005-143748 | A | 6/2005 |
| JP | 2009-112396 | A | 5/2009 |

OTHER PUBLICATIONS

Chinese Office Action issued in Chinese Application No. 201080046948.0 issued on Dec. 6, 2013.

* cited by examiner

BACKREST FOR CHAIR

RELATED APPLICATIONS

This application is the U.S. National Phase under 35 U.S.C. §371 of International Application No. PCT/JP2010/068340, filed on Oct. 19, 2010, which in turn claims the benefit of Japanese Application No. 2009-240145, filed on Oct. 19, 2009, the disclosures of which applications are incorporated by reference herein.

FIELD

The present invention relates to a backrest for a chair, the backrest having a back frame upholstered with a bag-like upholstery material by fitting the bag-like upholstery material onto the back frame.

BACKGROUND

This type of backrest is discussed in Patent Literatures 1 and 2, for example.

CITATION LIST

Patent Literature

Patent Literature 1: European Patent Application Publication No. 0922419

Patent Literature 2: Japanese Patent Application Laid-open No. 2003-135200

SUMMARY

Technical Problems

As a bag-like upholstery material for the backrests described in Patent Literatures 1 and 2, a meshed woven material of synthetic fibers is often used from the viewpoint of ventilation, stretch properties, and tensile strength, for example.

When such an upholstery material is used to upholster a back frame by fitting the upholstery material onto the back frame in a predetermined tensioned state, the inner peripheral surfaces of side portions of the bag-shaped upholstery material may strongly contact the outer surfaces of right and left side frames of the back frame, thereby creating large sliding resistance between the contacting portions and possibly resulting in the following problems.

For example, when a sitting person falls back on the backrest, a front-surface portion of the upholstery material positioned to the front of the back frame is warped backward, while a back-surface portion of the upholstery material positioned to the rear of the back frame is pulled around to the front-surface side of the upholstery material. At this time, when the sliding resistance at the area of contact between the right and left side frames of the back frame and the inner surfaces of the side portions of the upholstery material is large, smooth movement of the back-surface portion of the upholstery material toward the front-surface side is difficult. As a result, the front-surface portion of the upholstery material may fail to be effectively warped backward, or may lose flexibility, thus failing to support the back of the sitting person in a comfortable manner.

Further, when the sliding resistance at the area of contact between the side frames and the upholstery material is large, unpleasant sliding noise may be produced from the area of contact between the side frames and the upholstery material when the sitting person falls back onto the backrest.

The sliding resistance at the area of contact between the side portions of the upholstery material on a lower side thereof where the sitting person is supported around his or her hip and the side frames may be increased, while the sliding resistance at the area of contact between the side portions of the upholstery material on an upper side thereof supporting the person's back and the side frames may be reduced. In this way, areas around the hip may be comfortably supported by a lumbar support effect provided by the lower portion of the upholstery material, while also comfortably supporting the back. However, none of the inventions according to the cited literature address the problem of varying the sliding resistance.

For the foregoing reasons, there is a need for a backrest for a chair capable of providing a pleasant sense of sitting by allowing the front-surface portion of the upholstery material to be effectively warped backward; preventing the unpleasant sliding noise produced from the area of contact between the side frames of the back frame and the upholstery material; and comfortably supporting the hip and back of the sitting person.

Solution to Problem

The present invention is directed to a chair that satisfies the need by the following aspects.

(1) A backrest for a chair, comprising a bag-like upholstery material, with which a back frame is upholstered by fitting the bag-like upholstery material onto the back frame that has a pair of right and left side frames extending in an up-down direction, wherein a low-friction member is disposed on at least one of an inner surface of both side portions of the upholstery material and an outer surface of the right and left side frames contacting the inner surface of the side portions of the upholstery material, the low-friction member being configured to reduce a sliding resistance in an area of contact between the upholstery material and the side frames.

According to the above-described configuration, when the sitting person falls back on the backrest, the side portions of the upholstery material that are in contact with the outer surfaces of the side frames can be smoothly moved around toward the front side. Thus, the front-surface portion of the upholstery material can be effectively warped backward in such a manner as to fit the back of the sitting person, thereby providing a pleasant sense of seating.

Further, because the side portions of the upholstery material can be smoothly moved around to the front-surface side, the unpleasant sliding noise from the area of contact between the upholstery material and the side frames can be prevented.

(2) A backrest for a chair, comprising a bag-like upholstery material, with which a back frame is upholstered by fitting the bag-like upholstery material onto the back frame that has a pair of right and left side frames extending in an up-down direction, wherein a low-friction member is disposed on at least one of an inner surface of both side portions of the upholstery material on an upper portion side thereof supporting the back of a sitting person and an outer surface of the right and left side frames contacting the inner surface of the side portions of the upholstery material on an upper portion side thereof, the low-friction member being configured to reduce a sliding resistance in an area of contact between the upholstery material and the side frames, and a high-friction member is disposed on at least one of the inner surface of the side portions of the upholstery material on a lower portion side thereof supporting the sitting person around the hip and the outer surface of the right and left side frames contacting the inner surface of the side portions of the upholstery material on a lower portion side thereof, the high-friction member being configured to increase the sliding resistance in an area of contact between the upholstery material and the side frames.

According to the above-described configuration, when the sitting person falls back on the backrest, the side portions of the upholstery material on the upper side thereof that contact the outer surfaces of the frames can be smoothly moved around to the front side. Thus, the front-surface portion of the upholstery material on the upper portion side thereof supporting the back of the sitting person can be effectively warped backward in such a manner as to fit the back, while the side portions of the upholstery material on the lower portion side thereof supporting the sitting person around the hip can be prevented from being easily moved around toward the front side. Accordingly, an excessive backward warping of the front-surface portion of the upholstery material on the lower portion side can be prevented.

As a result, the back of the sitting person can be comfortably supported in a flexible manner while the sitting person can also be comfortably supported around the hip by the lumbar support effect. Thus, a pleasant sense of seating can be obtained.

Further, the lower portion of the upholstery material can be prevented from moving upward with respect to the side frames or from having a slack or wrinkles.

(3) In the above-described aspect (2), stitched portions are formed by internally folding and stitching both side-end portions of the upholstery material to cause the upholstery material to be bag-like, each of the stitched portions being covered by a side-end portion of the high-friction member fixed by stitching.

(4) In any the above-described aspects (1) to (3), stitched portions are formed by internally folding and stitching both side-end portions of the upholstery material to cause the upholstery material to be bag-like, each of the stitched portions being covered by a side-end portion of the low-friction member fixed by stitching.

According to the above-described configuration of aspect (3) or (4), the stitched portion of the side-end portions of the upholstery material is covered with the side-end portion of the low-friction member or the high-friction member by stitching. Thus, the stitched portion of the side-end portions of the upholstery material can be reinforced, so that the upholstery material can be prevented from being frayed.

Because the upholstery material can slide with respect to the side frames via the low-friction member or the high-friction member affixed to the inner surface of the side portions of the upholstery material, wearing of the side portions of the upholstery material can be reduced, so that the reupholstering intervals of the upholstery material can be extended and cost can be reduced.

(5) In any the above-described aspects (2) to (4), the high-friction member is formed by one of a polyurethane resin or a foam thereof, a urethane elastomer, and rubber.

(6) In any the above-described aspects (1) to (5), the low-friction member is formed by one of a polyamide resin, a fluororesin, and a polyacetal.

According to the above-described configuration of aspect (5) or (6), all of the recited materials are preferable for the low-friction member or the high-friction member, readily formable, and highly versatile. Thus, the structure can be relatively inexpensively implemented.

Advantageous Effects of Invention

The aspects of the present invention provide a backrest for a chair which backrest is capable of providing a pleasant sense of sitting by effectively warping the front-surface portion of the upholstery material backward; preventing the development of unpleasant sliding noise from the area of contact between the side frames of the back frame and the upholstery material; and comfortably supporting the hip and back of the sitting person.

DESCRIPTION OF EMBODIMENTS

In the following, embodiments of the present invention will be described with reference to the drawings.

Figure 1:
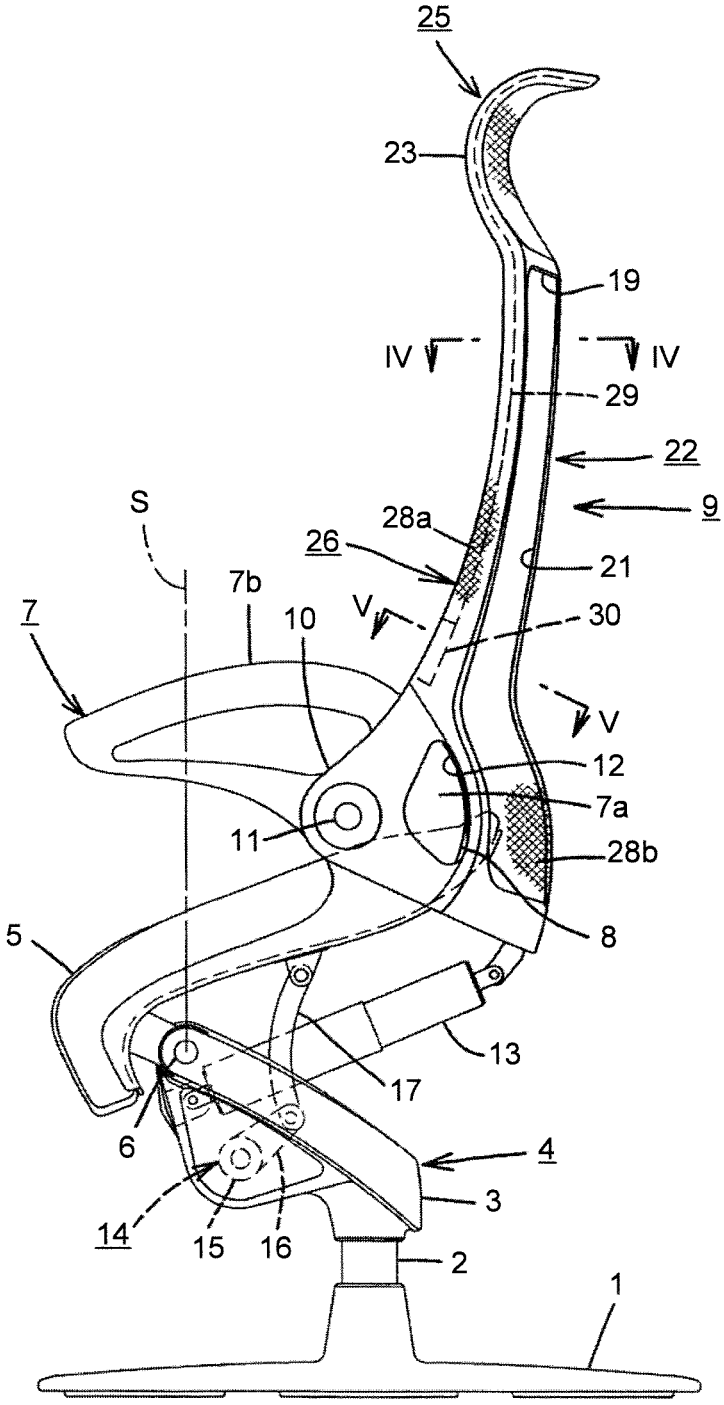
FIG. 1 is a side view of a chair equipped with a backrest according to an embodiment of the present invention in a standby state.
Figure 2:
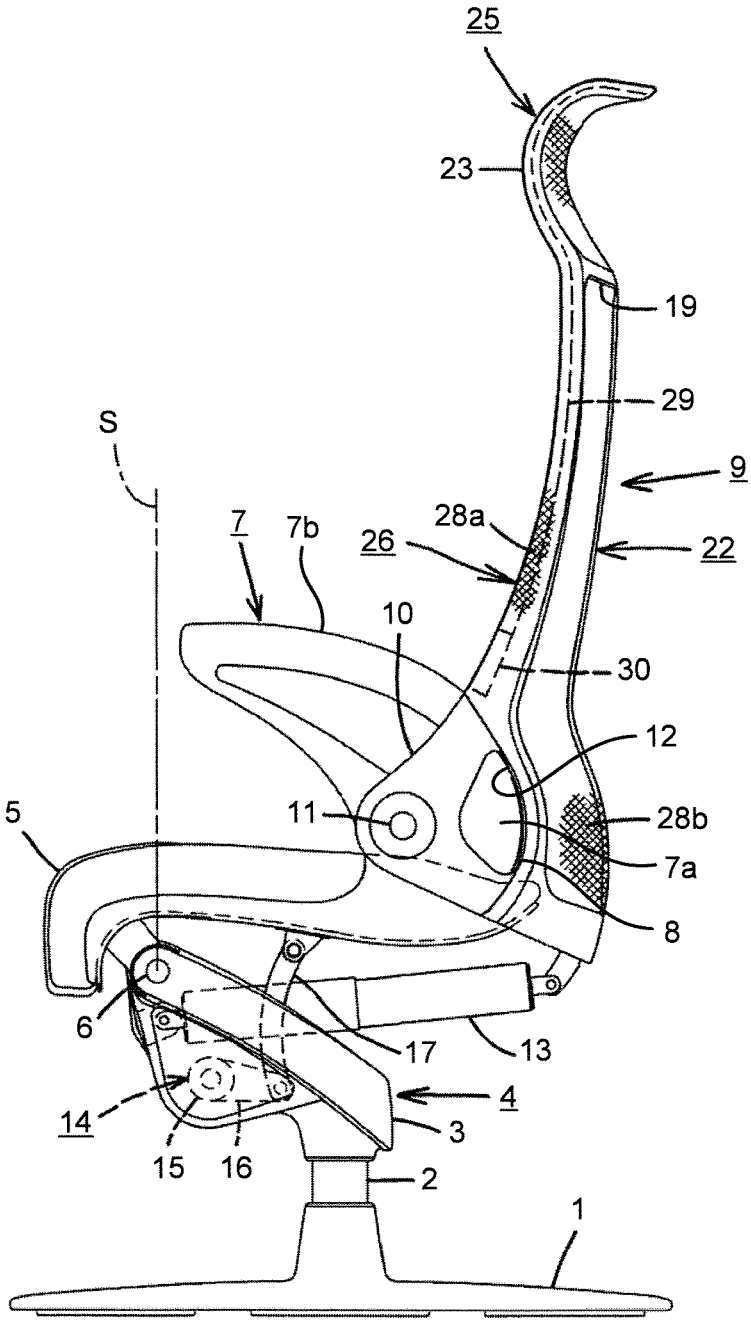
FIG. 2 is a side view of the chair of FIG. 1 in a seated state.

FIGS. 1 and 2 are side views of a chair including a backrest according to an embodiment of the present invention. The chair includes a lower assembly 4 which includes a disk-shaped base 1, a leg column 2 mounted at the center of the disk-shaped base 1 in an upright manner, and a support base 3 fixedly mounted on an upper end of the leg column 2.

The support base 3 has a substantially triangular shape expanding from the upper end of the leg column 2 toward the front in plan and side views.

At the front end of the support base 3, a front-lower portion of a seat 5 is pivotally mounted on a base axle 6 extending in a left-right direction. The seat 5 can be rotated about the base axle 6 into a standby position in which the seat 5 is inclined with its rear raised, as illustrated in FIG. 1, or into a use position in which the seat 5 is horizontal or inclined with its rear slightly lowered, as illustrated in FIG. 2.

On both sides of the rear of the seat 5, a pair of right and left arm rests 7 are integrally formed.

The arm rests 7 extend upward from the sides of the rear of the seat 5 and include a backrest pivotal support portion 7*a* and an arm pad portion 7*b*. The backrest pivotal support portion 7*a* includes a curved surface 8 protruding backward and having a semicircular or fan shape in a side view, which shape is centered about a support axle 11 of a backrest 9, which will be described later. The arm pad portion 7*b* extends forward from an upper portion of the backrest pivotal support portion 7*a* and has an upwardly arched shape. Thus, the arm rests 7 have a generally forwardly extending triangular shape converging in a forward-upper direction in a side view.

The arm pad portions 7*b* may be dimensioned with respect to the front-rear direction such that front-end portions of the arm pad portions 7*b* are positioned forwardly of a vertical line S passing through the center of the base axle 6, on which the seat 5 is pivoted, in the standby position illustrated in FIG. 1.

When the seat 5 is in the use position as illustrated in FIG. 2, the front-end portions of the arm pad portions 7*b* may be positioned slightly to the rear of the vertical line S corresponding to the base axle 6 on which the seat 5 is pivoted.

On outer surfaces of slightly forward portions of the backrest pivotal support portions 7*a* of the right and left arm rests 7, front-end portions of forwardly extending side pieces 10 extending forward from a lower portion of the backrest 9 on both sides are located. The front-end portions are pivoted on the support axle 11 extending substantially in the left-right direction. Thus, the backrest 9 can be rotated about the support axle 11 into an upright position illustrated in FIG. 2 or a backwardly inclined position, not illustrated, with respect to the seat 5 and the arm rests 7.

The backrest 9 includes a concave surface 12 facing the rear surface of the backrest pivotal support portions 7*a* and having an arch shape substantially complementary to the curved surface 8 on the rear surface of the backrest pivotal support portions 7*a*. Thus, the backrest 9 can be rotated about the support axle 11 with the opposed surfaces positioned close to each other. Between a central portion of a lower frame 20, which will be described later, of the backrest 9 with respect to the left-right direction and an upper surface of the front-end portion of the support base 3, a first biasing portion 13 for biasing the backrest 9 in an upright direction is provided. Examples of the first biasing portion 13 may include a gas spring and a compression spring.

The support base 3 includes a second biasing portion 14 for helping the sitting person stand up by biasing the seat 5 into the standby position.

The second biasing portion 14 includes a rubber torsion unit 15 having an axis in the left-right direction; a backwardly extending first link 16 linked with the rubber torsion unit 15 and biased in the anticlockwise direction in the side view of FIG. 1; and a second link 17 having a lower-end portion pivoted to the end of the first link 16 via an axis extending in the left-right direction. An upper end portion of the second link 17 is pivoted on a lower surface of the seat 5 in an intermediate area in the front-rear direction via an axis extending in the left-right direction, the second link 17 extending in a diagonally upward-rear direction.

Figure 3:
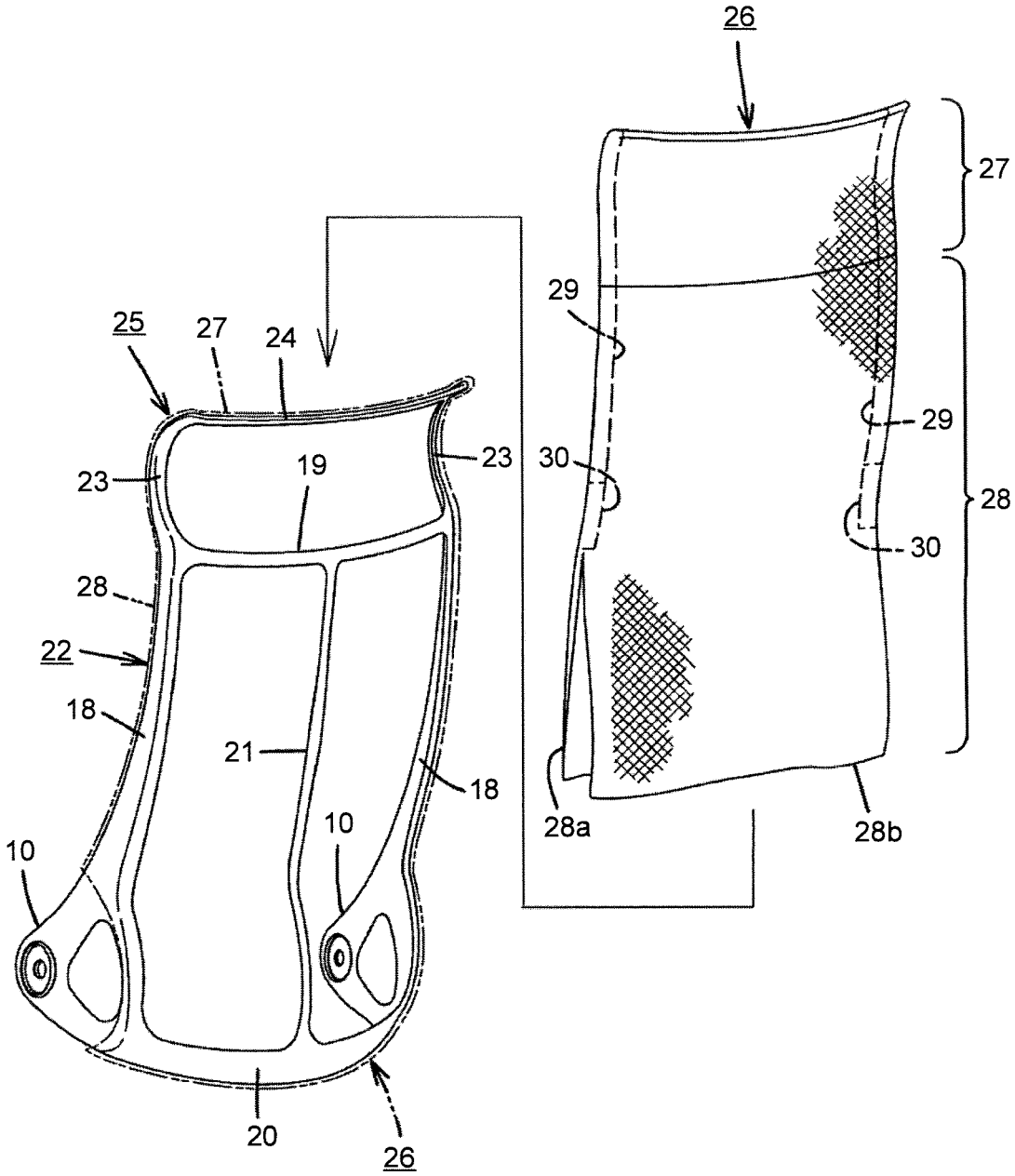
FIG. 3 is a perspective view of the backrest as seen from diagonally behind, in a state before a back frame is upholstered with an upholstery material.

As illustrated in FIG. 3, the backrest 9 extends in the up-down direction and includes a back frame 22 having a vertically longer rectangular shape in a front elevation. The back frame 22 includes a pair of right and left side frames 18 extending in the up-down direction and having a gradually increasing front-rear dimension toward the lower ends with which the forwardly extending side pieces 10 are continuously connected. The upper ends of the side frames 18 are coupled via an upper frame 19 extending in the left-right direction. The lower ends of the side frames 18 are coupled via a lower frame 20 extending in the left-right direction. The upper frame 19 and the lower frame 20 are coupled at their intermediate portions in the left-right direction via an intermediate frame 21 which is positioned backwardly of the side frames 18 and extending in the up-down direction.

The back frame 22 may be integrally formed from a synthetic resin material having an appropriate elasticity. Preferably, the synthetic resin material may contain reinforced fibers, such as glass or carbon fibers, for increased strength.

The lower portions of the side frames 18 and a lower portion of the intermediate frame 21 are arched with the center of curvature located forwardly in a side view. The upper frame 19 and the lower frame 20 are curved in a plan view, with their intermediate portions positioned backwardly of their side portions. Thus, when the back frame 22 is upholstered with a bag-like upholstery material 26 as will be described later, a front-surface portion and a back-surface portion of the upholstery material 26 with respect to the back frame 22 are allowed to be relatively greatly spaced apart from each other in the front-rear direction.

Further, the lower portion of the backrest 9 is also backwardly spaced from the rear ends of the seat 5 and the arm rests 7. Thus, when the backrest 9 is rotated, interference with the rear ends of the seat 5 and the arm rests 7 is prevented, so that the backrest 9 can have a large range of backward rotation.

The intermediate frame 21 may be thinner than the other frame forming members of the back frame 22 so that the intermediate frame 21 can be more readily elastically deformed than the other members. In this way, when the front-surface portion of the upholstery material 26 is subjected to a load as will be described later, the intermediate frame 21 can be elastically deformed in the backward direction.

At the upper end of the back frame 22, a head-rest frame 25 is integrally formed. The head-rest frame 25 includes upwardly extending extension frames 23 which are curved with intermediate portions thereof positioned forwardly of the upper and lower portions thereof in a side view. Upper ends of the extension frames 23 are coupled to each other via a top frame 24 extending in the left-right direction.

As illustrated in FIG. 3, the back frame 22 and the head-rest frame 25 are upholstered from above with the bag-like upholstery material 26 by fitting the bag-like upholstery material 26 onto the back frame 22 and the head-rest frame 25. The upholstery material 26 includes openings in the lower end and lower-side portions, and has stretch properties. The upholstery material 26 may be in the form of a mesh woven from synthetic fibers. The upholstery material 26 includes a head-rest covering portion 27 covering the head-rest frame 25, and a backrest covering portion 28 covering the back frame 22.

The back frame 22 and the head-rest frame 25 are covered with the upholstery material 26 in a predetermined tensioned state. The right and left forwardly extending side pieces 10 protrude in the forward direction through the lower-side openings of the upholstery material 26. Lower-end portions of a front-surface portion 28*a* and a back-surface portion 28*b* of the upholstery material 26 positioned to the front and rear of the back frame 22, respectively, are joined to each other via a joining means below the lower frame 20 of the back frame 22. Examples of the joining means include hook-and-loop fasteners, hooks, and zippers (not illustrated).

When the head rest is not required, the head-rest frame 25 and the head-rest covering portion 27 of the upholstery material 26 may be omitted.

As illustrated in FIGS. 3 to 7, thin and flexible low-friction members 29 having small sliding resistance with respect to the frames 18 and 23 are disposed on inner surfaces of the side portions of the upholstery material 26 that contact outer surfaces of the side frames 18 of the back frame 22 excepting the forwardly extending side pieces 10, and outer surfaces of the extension frames 23 of the head-rest frame 25.

Thin and flexible high-friction members 30 having large sliding resistance with respect to the side frames 18 are disposed on inner surfaces of the side portions of the upholstery material 26 where the sitting person is supported around his or her hip, the inner surfaces contacting the outer surfaces of lower portions of the side frames 18.

Preferably, the low-friction members 29 may include a material such as a polyamide resin (trade name Nylon), fluororesin (Teflon (registered trademark); trade name Daiflon), or polyacetal. The high-friction members 30 may include a material such as a polyurethane resin or a foam thereof, a urethane elastomer, or rubber.

Figure 6:
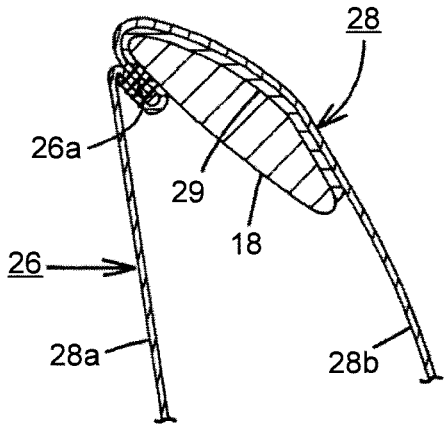
FIG. 6 is an enlarged view of a portion A of FIG. 4.
Figure 7:
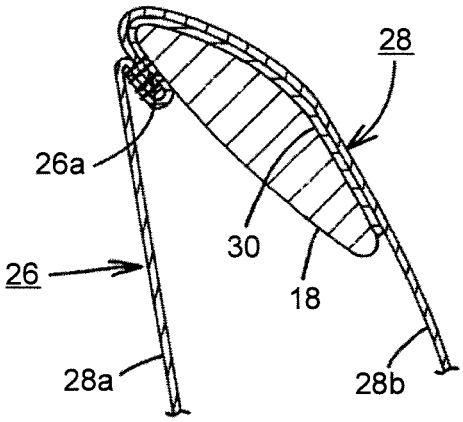
FIG. 7 is an enlarged view of a portion B of FIG. 5.

As illustrated in enlarged cross sections of FIGS. 6 and 7, the side-end portions of the upholstery material 26 are inwardly folded into layers and stitched into bag-shaped portions at positions close to the inner surfaces on the front side of the right and left side frames 18 or extension frames 23. At the same time, the front-end portions of the low-friction member 29 and the high-friction member 30 are folded into U-shaped portions by which the folded portions of the upholstery material 26 are covered by stitching. In this way, stitched portions 26*a* of the side-end portions of the upholstery material 26 can be reinforced. The front-end portions of the low-friction member 29 and the high-friction member 30 may be simply stitched onto the stitched portions 26*a* of the side-end portions of the upholstery material 26 simultaneously without being folded in U-shape.

The low-friction member 29 and the high-friction member 30 may be affixed onto the outer surfaces of the side frames 18 and the extension frames 23 or onto the inner surfaces of the side portions of the upholstery material 26 by using an adhesive, rather than by stitching.

Figure 8:
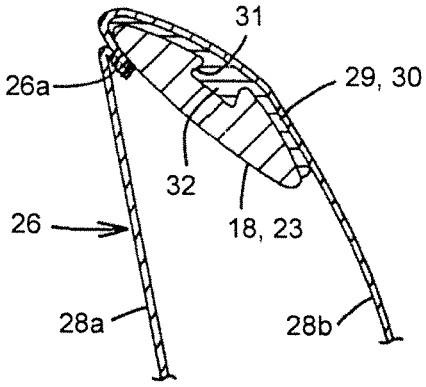
FIG. 8 is an enlarged cross section illustrating a manner of attaching a low-friction member and a high-friction member to the back frame according to a variation.

As illustrated in FIG. 8, a concave groove 31 may be formed in the outer surfaces of the side frames 18 and the extension frames 23 in the up-down direction, and a convex portion 32 may be formed on inner surfaces of the low-friction member 29 and the high-friction member 30 in the up-down direction. In this way, by fitting the convex portion 32 in the concave groove 31, the low-friction member 29 and the high-friction member 30 can be detachably mounted on the outer surfaces of the side frames 18 and the extension frames 23.

Figure 9:
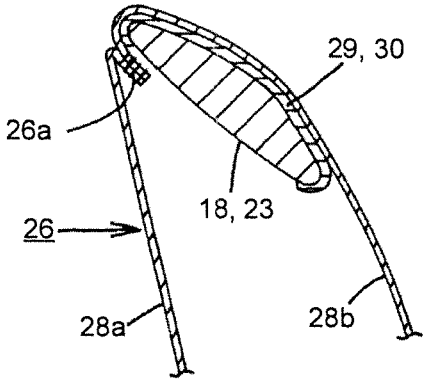
FIG. 9 is an enlarged cross section illustrating a manner of attaching the low-friction member and the high-friction member to the back frame according to another variation.

Further, as illustrated in FIG. 9, the low-friction member 29 and the high-friction member 30 configured to be elastically deformable may be detachably fitted on the outer surfaces of the side frames 18 and the extension frames 23. In this case, the concave groove 31 illustrated in FIG. 8 may not be provided in the side frames 18 and the extension frames 23.

The low-friction member 29 and the high-friction member 30 may be a film formed on the outer surfaces of the side frames 18 and the extension frames 23 by coating.

Figure 4:
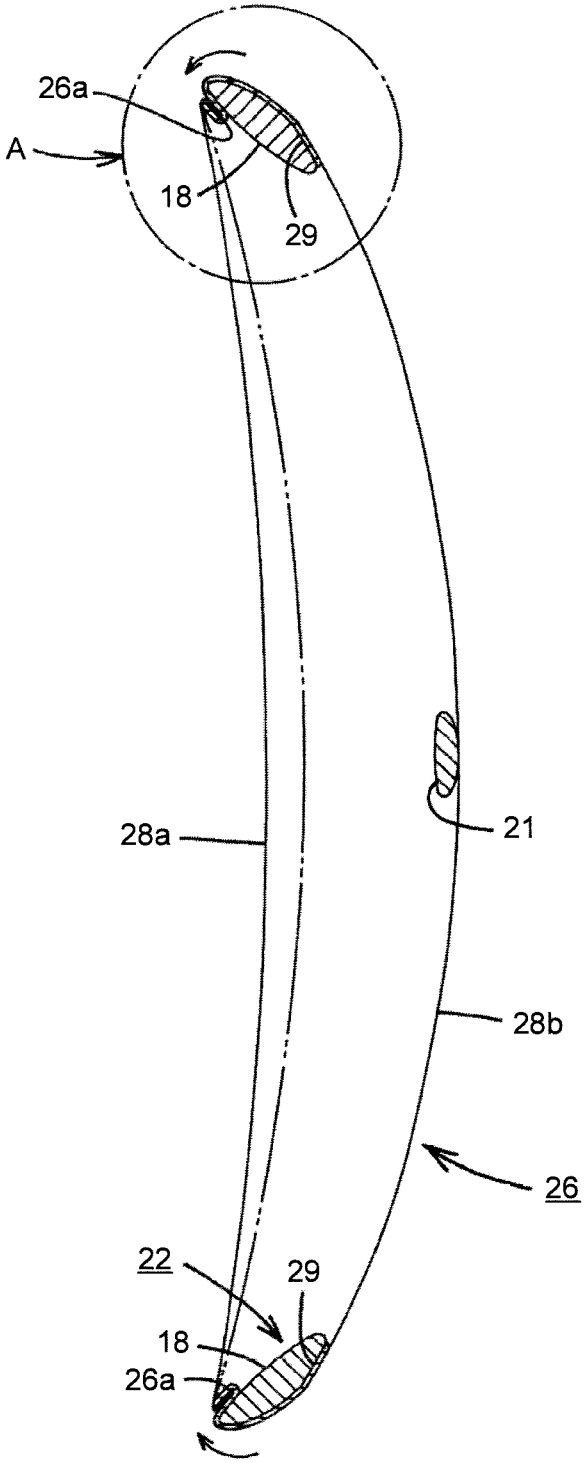
FIG. 4 is an enlarged cross section taken along line IV-IV of FIG. 1.
Figure 5:
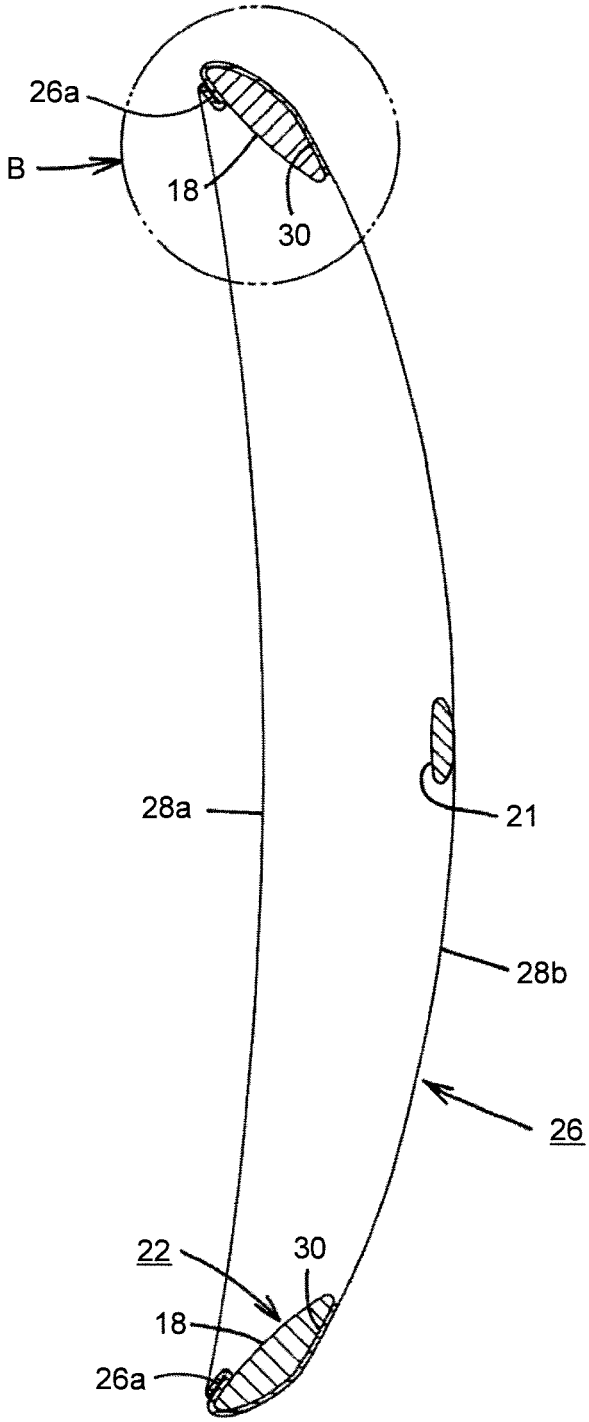
FIG. 5 is an enlarged cross section taken along line V-V of FIG. 1.

When the sitting person falls back on the backrest 9 structured as described above, the back-surface portion 28*b* of the upholstery material 26 is pulled and extended as the front-surface portion 28*a* of the upholstery material 26 is extended and warped backward, as indicated by the two-dot chain line in FIG. 4. As a result, the side portions of the upholstery material 26 are pulled around toward the front-surface portion 28*a* to some extent, as indicated by arrows, so that the amount of warping of the front-surface portion 28*a* in the backward direction increases. At this time, because the low-friction members 29 attached to the inner surfaces of the side portions of the upholstery material 26 are in contact with the outer surfaces of the side frames 18 except for the lower portions thereof and with the outer surfaces of the extension frames 23, the sliding resistance at their areas of contact is reduced.

Consequently, the upper side portions of the upholstery material 26 are permitted to smoothly move around toward the front surface side, so that the front-surface portion 28*a* of the upholstery material 26 supporting the back and head of the sitting person can be effectively warped backward in such a manner as to fit the back and head of the sitting person. Thus, the back and head of the sitting person can be comfortably supported with flexibility.

Also, the development of unpleasant sliding noise can be prevented when the side portions of the upholstery material 26 are moved around toward the front-surface portion 28*a*.

Further, because the upholstery material 26 slides with respect to the side frames 18 via the low-friction members 29 affixed on the inner surfaces of the side portions of the upholstery material 26, wearing of the side portions of the upholstery material 26 can be reduced, so that the reupholstering intervals can be extended and cost can be reduced.

On the other hand, the high-friction members 30 are attached to the inner surfaces of the side portions of the upholstery material 26 where the sitting person is supported around the hip, the inner surfaces contacting the outer surfaces of the lower portions of the right and left side frames 18. Thus, the sliding resistance between the side frames 18 and the lower side portions of the upholstery material 26 is increased.

As a result, even when the lower portions of the side frames 18 are curved into an arch shape extending forward, the lower portions of the side portions of the upholstery material 26 are prevented from moving up, thus preventing slackening or development of wrinkles in the lower portion of the upholstery material 26.

Further, because the movement of the lower side portions of the upholstery material 26 toward the front side of the back frame 22 is prevented or reduced, the lower portion of the front-surface portion 28*a* of the upholstery material 26 where the sitting person is supported around the hip can be maintained in a properly tensioned state and prevented from being excessively warped backward. Thus, the lumbar support effect can be obtained and the hip of the sitting person can be comfortably supported, thereby providing enhanced comfort to the sitting person.

In the embodiments illustrated in FIGS. 8 and 9, the side portions of the upholstery material 26 can slide with respect to the low-friction member 29 and the high-friction member 30 attached to the side frames 18. Thus, effects similar to those described above can be obtained because of the small and large sliding resistances provided between the upholstery material 26 and the side frames 18.

The present invention is not limited to the foregoing embodiments and may include various other modifications or implementations.

For example, while the low-friction member 29 according to the foregoing embodiments has been described as being long and continuous in the up-down direction, a plurality of short low-friction members 29 may be disposed at predetermined intervals in the up-down direction.

In the foregoing embodiments, the low-friction members 29 may be disposed on the inner surfaces of the side portions of the upholstery material 26 or on the outer surfaces of the side frames 18. The low-friction members 29 may be disposed on both the outer surfaces of the side frames 18 and the inner surfaces of the side portions of the upholstery material 26, so that the low-friction members 29 can be contacted with each other.

The present invention may be applied to the backrest for conventional chairs having the seat 5 that is not inclined up or down.

REFERENCE SIGNS LIST

1 BASE
2 LEG COLUMN
3 SUPPORT BASE
4 LOWER ASSEMBLY
5 SEAT

6 BASE AXLE
7 ARM REST
7*a* BACKREST PIVOTAL SUPPORT PORTION
7*b* ARM PAD PORTION
8 CURVED SURFACE
9 BACKREST
10 FORWARDLY EXTENDING SIDE PIECE
11 SUPPORT AXLE
12 CONCAVE SURFACE
13 FIRST BIASING PORTION
14 SECOND BIASING PORTION
15 RUBBER TORSION UNIT
16 FIRST LINK
17 SECOND LINK
18 SIDE FRAME
19 UPPER FRAME
20 LOWER FRAME
21 INTERMEDIATE FRAME
22 BACK FRAME
23 EXTENSION FRAME
24 TOP FRAME
25 HEAD-REST FRAME
26 UPHOLSTERY MATERIAL
26*a* STITCHED PORTION
27 HEAD-REST COVERING PORTION
28 BACKREST COVERING PORTION
28*a* FRONT-SURFACE PORTION
28*b* BACK-SURFACE PORTION
29 LOW-FRICTION MEMBER
30 HIGH-FRICTION MEMBER
31 CONCAVE GROOVE
32 CONVEX PORTION
S VERTICAL LINE

The invention claimed is:

1. A backrest for a chair, comprising:

a bag-like upholstery material, with which a back frame is upholstered by fitting the bag-like upholstery material onto the back frame that has a pair of right and left side frames extending in an up-down direction; and a low-friction material disposed between the right side frame and an inner part of the upholstery material contacting the right side frame and between the left side frame and an inner part of the upholstery material contacting the left side frame, wherein sliding friction between the right side frame and the upholstery material and between the left side frame and the upholstery material with the low-friction material is lower than sliding friction between the right side frame and the upholstery material and between the left side frame and the upholstery material without the low-friction material.

2. A backrest for a chair, comprising:

a bag-like upholstery material, with which a back frame is upholstered by fitting the bag-like upholstery material onto the back frame that has a pair of right and left side frames extending in an up-down direction;

a low-friction material disposed between an upper part of the right side frame and an upper inner part of the upholstery material contacting the upper part of the right side frame and between an upper part of the left side frame and an upper inner part of the upholstery material contacting the upper part of the left side frame; and a high-friction material disposed between a lower part of the right side frame and a lower inner part of the upholstery material contacting the lower part of the right side frame and between a lower part of the left side frame and a lower inner part of the upholstery material contacting the lower part of he left side frame, wherein sliding friction between the upper part of the right side frame and the upper inner part of the upholstery material and between the upper part of the left side frame and the upper inter part of the upholstery material with the low-friction material is lower than sliding friction between the right side frame and the upholstery material and between the left side frame and the upholstery material without the low-friction material, and sliding friction between the lower part of the right side frame and the lower inner part of the upholstery material and between the lower part of the left side frame and the lower inner part of the upholstery material with the high-friction material is greater than sliding friction between the right side frame and the upholstery material and between the left side frame and the upholstery material without the low-friction material.

3. The backrest for a chair according to claim 2, wherein stitched portions are formed by internally folding and stitching both side-end portions of the upholstery material to cause the upholstery material to be bag-like, each of the stitched portions being covered by a side-end portion of the high-friction material fixed by stitching.

4. The backrest for a chair according to claim 2, wherein stitched portions are formed by internally folding and stitching both side-end portions of the upholstery material to cause the upholstery material to be bag-like, each of the stitched portions being covered by a side-end portion of the low-friction material fixed by stitching.

5. The backrest for a chair according to claim 2, wherein the high-friction material is formed by one of a polyurethane resin or a foam thereof, a urethane elastomer, and rubber.

6. The backrest for a chair according to claim 1, wherein the low-friction material is formed by one of a polyamide resin, a fluororesin, and a polyacetal.

7. The backrest for a chair according to claim 2, wherein the low-friction material is formed by one of a polyamide resin, a fluororesin, and a polyacetal.

* * * * *